US006076754A

United States Patent [19]

Kesig et al.

[11] Patent Number: 6,076,754

[45] Date of Patent: Jun. 20, 2000

[54] MIXER APPARATUS WITH IMPROVED CHOPPER ASSEMBLY

[75] Inventors: Ricky D. Kesig; Michael J. Stokes, both of Cincinnati, Ohio

[73] Assignee: Littleford Day, Incorporated, Florence, Ky.

[21] Appl. No.: 09/293,379

[22] Filed: Apr. 16, 1999

[51] Int. Cl.[7] ..... B02C 13/00; B02C 18/14

[52] U.S. Cl. ..... 241/101.2; 241/101.8; 241/282.1; 241/300

[58] Field of Search ..... 241/101.2, 101.8, 241/282.1, 292.1, 300

[56] References Cited

U.S. PATENT DOCUMENTS

| | | | |
|---|---|---|---|
| 1,950,355 | 3/1934 | De Bats . | |
| 1,960,879 | 5/1934 | Russlell et al. . | |
| 1,965,950 | 7/1934 | Walker . | |
| 1,974,215 | 9/1934 | Kilmer . | |
| 2,033,594 | 3/1936 | Stody . | |
| 2,184,776 | 12/1939 | Cottrell . | |
| 2,413,989 | 1/1947 | Molner et al. . | |
| 3,553,905 | 1/1971 | Lemelson . | |
| 3,559,957 | 2/1971 | Hurter . | |
| 3,974,969 | 8/1976 | Herbst, Sr. | 241/98 |
| 3,975,891 | 8/1976 | Gunther . | |
| 4,068,688 | 1/1978 | Benson | 241/292.1 X |
| 4,189,242 | 2/1980 | Luke . | |
| 4,214,376 | 7/1980 | Lucke et al. . | |
| 4,307,845 | 12/1981 | Larimer et al. . | |
| 4,462,293 | 7/1984 | Gunzner . | |
| 4,509,860 | 4/1985 | Lasar, III . | |
| 4,705,222 | 11/1987 | Shobet . | |
| 4,726,755 | 2/1988 | Holley . | |
| 4,786,001 | 11/1988 | Ephraim et al. | 241/101.8 |
| 4,860,960 | 8/1989 | Schwarz . | |
| 4,881,887 | 11/1989 | Holley . | |
| 4,940,188 | 7/1990 | Rodriguez et al. . | |
| 5,094,540 | 3/1992 | Face, Jr. . | |
| 5,106,674 | 4/1992 | Okada et al. . | |
| 5,195,404 | 3/1993 | Notter et al. . | |
| 5,275,484 | 1/1994 | Shobet . | |
| 5,292,193 | 3/1994 | Funk . | |
| 5,333,520 | 8/1994 | Fischer et al. . | |
| 5,409,313 | 4/1995 | Funk . | |
| 5,486,072 | 1/1996 | Green . | |
| 5,516,053 | 5/1996 | Hannu . | |
| 5,791,570 | 8/1998 | Quadrana | 241/82.5 |

*Primary Examiner*—John M. Husar
*Attorney, Agent, or Firm*—Wood, Herron & Evans, LLP

[57] ABSTRACT

A mixer for mixing and processing materials comprises a mixing chamber with a mixing space therein, an elongated rotatable mixing shaft extending through the mixing space, and a drive apparatus for rotating the shaft. At least one mixing element is coupled to the elongated shaft for being rotated to mix material. A chopper assembly comprises a chopper shaft and at least one chopper blade coupled to the shaft to be rotated thereby for chopping material being mixed in the mixing space. The chopper blade comprises an elongated blade body with at least one cutting edge, and an edge plate is formed of a wear resistant material and mounted to the cutting edge of the chopper blade to overlie the cutting edge, the edge plate being wider than the cutting edge to prevent premature wear of the cutting edge.

9 Claims, 4 Drawing Sheets

MIXER APPARATUS WITH IMPROVED CHOPPER ASSEMBLY

FIELD OF THE INVENTION

This invention relates generally to an apparatus for industrial mixing and processing and particularly to mixers having chopper assemblies extending into the mixing chamber for adding shear and/or dispensing materials within the mixing chamber.

BACKGROUND OF THE INVENTION

Processing of a large variety of consumer and industrial products, such as food, plastic, pharmaceutical and chemical products, usually involves one or more mixing steps for mixing the component materials of the products. Such mixing steps are oftentimes accompanied by simultaneous drying of the material being mixed and granulation of the material.

For accomplishing such mixing, large-capacity industrial mixers are utilized which are able to handle very large loads of material for more efficient and cost-effective mixing. One type of mixer design, which is able to effectively mix large loads of material, is referred to as a horizontal mixer because its elongated mixing chamber is disposed generally horizontally with respect to the ground surface on which it rests. More specifically, horizontal mixers generally comprise a mixing chamber, an elongated, horizontal mixing shaft which rotates, and a plurality of mixing tools, such as mixing plows, which extend generally perpendicularly from the horizontal shaft to rotate around the inside of the chamber. The mixing plows are configured and dimensioned as required for the mixing process to follow the cylindrical inside walls of the chamber for proper mixing of all of the material in the chamber when the mixing shaft rotates.

Supplementing the mixing action within the chamber that is provided by the plows, are chopper assemblies which include chopper blades. The chopper assemblies operate in conjunction with the mixing plows to enhance the mixing process. The chopper blades of the assemblies are positioned to rotate and thereby chop material within the mixing chamber. To that end, the blades are coupled to chopper shafts linked to a motor, which is generally mounted outside of the chamber. Usually a plurality of chopper assemblies are utilized with the mixer, each assembly being powered independently from the other by a separate shaft and motor. The assemblies are operable for rotating the blades in the range of approximately 3000–3600 RPM, for example, and are used for a variety of purposes within the mixing process. Each assembly will usually include multiple, staggered blades on a shaft for more intense action.

For example, chopper blades are used to quickly mix and disperse minor ingredients within a mixed solution. The chopper blades also are used to introduce high impact and shear to a material mixture, such as to introduce heat into the mixture. Still further, the chopper blades are utilized for other process steps, such as dispensing fluids through a mixed solution, reduction of the size of particles formed within the material mixture, and the break up of agglomerates within the mixed material (i.e., deagglomeration).

Typical chopper blades in available mixers are made of stainless steel. Due to their high rotational speeds and the high impact and shear the blades introduce to a material mixture, chopper blades are subject to a significant amount of wear during a mixing process. Such wear eventually limits the useful life of the blades. For example, FIG. 2A illustrates a typical chopper blade 2 formed of stainless steel and having cutting edges 4, 5 and an aperture 6 for mounting the blade to a chopper shaft for rotation. FIG. 2B illustrates the same blade after it has been used within a mixer for a certain amount of time. The cutting edges 4, 5 are significantly worn, as may be seen in the figure. As a result, blade 2 must be periodically replaced in the mixer. Such constant replacement increases the cost of maintenance and operation of the mixer. Not only do new chopper blades have to be purchased, but the mixer itself has to be shut down for the necessary blade replacements and maintenance. This amounts to a significant cost. As many as eight blades per assembly, and four or more assemblies per mixer (32 blades) may need to be maintained and replaced. Furthermore, the shutdown decreases the overall efficiency of the mixer and the mixing process.

Wear of the blades also may present a possibility of product contamination. The particles from the worn blades mix with the product in the mixer.

Certain attempts have been made to increase the useful life of chopper blades used in mixers. For example, abrasion resistant coatings are often applied to blades to increase their effective life. Furthermore, different materials for formulating the blades have been tried. However, despite these various efforts, there is still a need in the art for improvements to mixers using chopper assemblies with chopper blades to increase the effective life of the blades, increase the overall efficiency of the mixing process, and thereby reduce the costs of operating and maintaining a mixer.

Therefore, it is an objective of the invention to improve material mixers and to increase their operational life span between maintenance shutdowns.

It is another objective to improve material mixers by increasing the effective operational life of chopper blades used in such mixers.

It is still another objective of the invention to increase the efficiency of an industrial mixing process and to reduce the operational and maintenance costs of a mixing process.

It is another objective to minimize product contamination by reducing blade wear.

These objectives and other objectives are addressed by the invention as set forth below in the description of the invention.

SUMMARY OF THE INVENTION

A mixer f or mixing and processing materials comprises a mixing chamber with a mixing space therein configured for receiving material to be mixed. An elongated, rotatable mixing shaft extends into the mixing space and is driven by a drive apparatus. A plurality of mixing elements are coupled to the elongated shaft, being rotated within the mixing space to mix material within the space.

In cooperation with the mixing elements, a plurality of chopper assemblies are utilized. The chopper assemblies comprise the chopper shaft extending into the mixing space, which shaft may be rotated. A plurality of chopper blades are coupled to the shaft, and each chopper blade comprises an elongated body having at least one cutting edge which is dimensioned to have a first width. A tungsten carbide edge plate is mounted to the cutting edge of the chopper blade and overlies the cutting edge. The edge plate has a second width which is wider than the first width of the blade cutting edge and overlies the cutting edge to prevent premature wear of the cutting edge. The edge plate includes a body section and tip section wherein the body section is a first thickness which gradually increases up to the tip section, having a second thickness greater than the first thickness.

The invention reduces the cost of maintaining and operating a mixer and increases the overall efficiency of the mixing process. Other features and advantages of the present invention are set forth herein below in the Detailed Description of the invention.

BRIEF DESCRIPTION OF THE DRAWINGS

The accompanying drawings, which are incorporated in and constitute a part of this specification, illustrate embodiments of the invention, and together with a general description of the invention given above, and the detailed description of the embodiments given below, serve to explain the principles of the invention.

DETAILED DESCRIPTION OF SPECIFIC EMBODIMENTS

Figure 1:
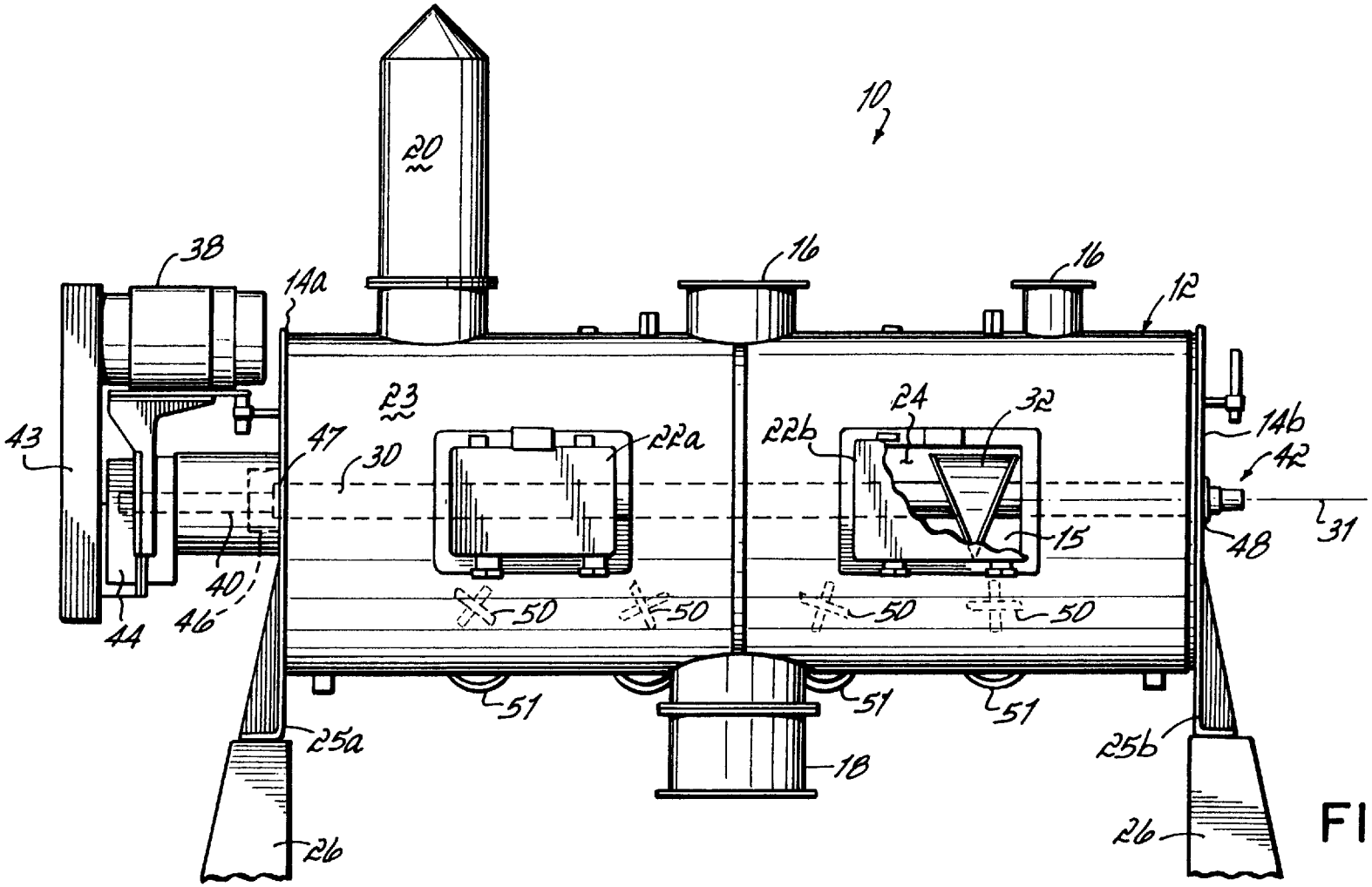
FIG. 1 is a front view of a mixer constructed in accordance with the principles of the present invention.

FIG. 1 illustrates a mixer 10 which utilizes a chopper assembly and mixing elements in accordance with the principles of the present invention. The embodiment of the mixer 10 illustrated in FIG. 1, referred to as a horizontal mixer, comprises a generally cylindrical and elongated mixing chamber 12 which is horizontally disposed and configured to receive therein material which is to be mixed, such as food material, pharmaceutical material, chemicals, or plastic material, for example. The cylindrical chamber 12 has a generally cylindrically-shaped side wall and opposing end walls or head walls 14*a*, 14*b* which close the ends of the chamber to contain the mixed material. The chamber defines an inside mixing space 15 for mixing the material. Although a cylindrically-shaped chamber 12 is illustrated, other mixer shapes might also be utilized.

Mixer 10 further includes one or more charge ports 16 and one or more discharge ports 18 utilized for charging the chamber with materials to be mixed and chopped, and discharging the mixed material from chamber 12 after it has been properly processed. The mixer 10 of the invention may also include a ventilation port 20 or other appropriate structure for ventilating any fumes or vapors generated during the mixing process and also for facilitating charge and discharge of product. Furthermore, other apparatuses, such as heaters (not shown), may also be utilized with mixer 10 in order to dry or heat the material being mixed. Access to the inside of chamber 12 is provided by access doors 22*a*, 22*b* which are hingedly coupled to the outside surface 23 or man way of the cylindrical side wall of the chamber 12.

The inside surface 24 of the cylindrical side wall which defines inside mixing space 15 is preferably polished so that the mixed material slides easily thereover for mixing, chopping, and discharging as required. Mixer 10 might be, for example, a large capacity mixer with a capacity in the range of approximately 300–30,000 liters and therefore, the components of the mixer are expected to handle substantial mixing loads. The end walls 14*a*, 14*b* include respective leg extension portions 25*a*, 25*b* which are mounted on an appropriate support structure 26 for elevating the mixing chamber 12 and particularly the discharge port 18 above a ground surface. Alternatively, mixer 10 might be mounted directly on the ground as long as sufficient clearance of discharge port 18 is provided.

For mixing material within space 15 of chamber 12, the horizontal mixer 10 of the invention further comprises a horizontal mixing shaft 30, having a longitudinal axis 31 which is horizontally disposed so that the shaft is preferably coaxially mounted with the cylindrically-shaped chamber 12. Shaft 30 is heavily constructed for handling the large load mixing of mixer 10 and is fabricated of any suitable material, for example, stainless steel. The length of the shaft 30 will vary with the size and capacity of the mixer 10.

A plurality of mixing elements or tools, such as mixing plows 32, are coupled to the shaft 30 by support arms (not shown) which are appropriately secured to shaft 30. Multiple mixing tools are utilized, although only one is shown in FIG. 1. Preferably, the mixing tools 32 are staggered both longitudinally on shaft 30 and also radially around shaft 30 as appropriate to provide proper mixing. The mixing tools 32 are configured and positioned so that the head or plow of the mixing tool sweeps freely past the polished inside surface 24 of the cylindrically-shaped chamber 12. The spacing of the tools 32 from the inside surface 24 is varied depending upon the mixing process. In that way, the mixing tools can engage, move, and therefore mix the material in the chamber without leaving any residual material unmixed against the inside surface 24 of the side wall. Therefore, proper spacing between the mixing tools 32 and surface 24 is desirable.

Shaft 30 of the invention includes a driven end or drive end 40 and a non-driven end or stub end 42 opposite the drive end 40. In one suitable mixer design, a drive apparatus, such as a drive motor 38, is operably coupled to a belt drive 43 which, in turn, is operably coupled to the shaft drive end 40 by an appropriate gear box and bearing structure 44. The gear box and bearing structure 44 will generally reduce the drive ratio between the drive motor 42 and shaft 30. A dynamic seal structure 46 is coupled to drive end 40 between the gear box and bearing structure 44 and the respective chamber end wall 14*a*. The shaft drive end 40 protrudes through an appropriate opening 47 in end wall 14*a* while the stub end 42 protrudes through an appropriate opening 48 in the end wall 14*b*.

The dynamic seal structure 46 seals opening 47 to prevent the migration of mixed material out of chamber 12 and into the atmosphere along the shaft 30 and through the opening 47. Seal structure 46 may comprise a series of adjacent braided packing elements (not shown) and also may include an air line (not shown) for preventing leakage as discussed above. Furthermore, seal structure 46 preferably prevents any entry of foreign matter into the mixing chamber 12 through opening 47. Seal structure 46 is an appropriate dynamic seal for sealing the shaft drive end 40 and the opening 47 while allowing rotation of the shaft 30. To that end, sealing structure 46 might also utilize appropriate air or fluid lines (not shown) to maintain a vacuum or pressurized environment within chamber 12 as necessary for properly mixing and containing the material in chamber 12.

As illustrated in FIG. 1, drive motor 38 is indirectly coupled to shaft drive end 40 by belt drive 43 and is positioned above the shaft drive end 40. However, for larger mixer applications and for a higher power drive motor, the drive motor 38 might be directly coupled to shaft 30 by an appropriate gear and coupling structure, bearing structure, and a separate seal structure.

Figure 1A:
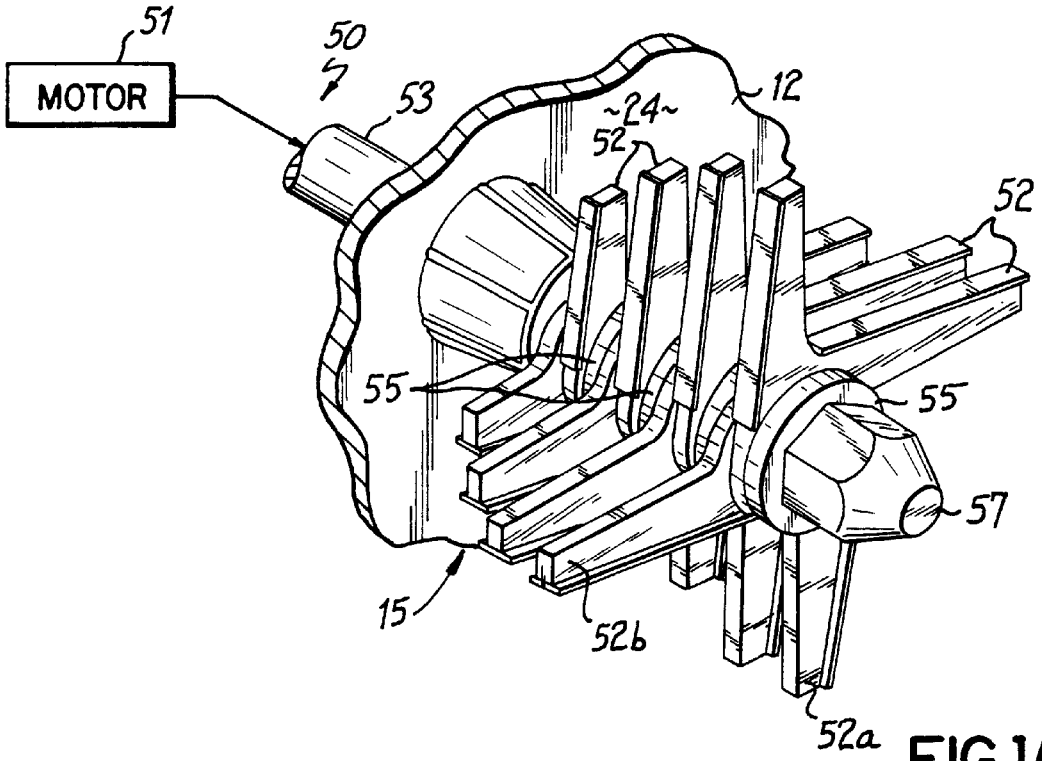
FIG. 1A is a perspective view of a chopper assembly used in a mixer as shown in FIG. 1, in accordance with the principles of the invention.

In accordance with the principles of the present invention, mixer 10 also includes a plurality of chopper assemblies 50. The chopper assemblies include a plurality of chopper blades 52 which are coupled to a rotatable chopper shaft 53 (see FIG. 1A). Chopper shaft 53 is driven by a motor 51. The chopper shaft 53 ends through the sidewall of chamber 12 as illustrated in FIG. 1A and the motor 51 is mounted to the outside of the chamber 12 as illustrated in FIG. 1. Preferably, as shown in FIG. 1, numerous chopper assemblies 50 are utilized along the length of the mixer 10. The chopper assemblies 50 are utilized in conjunction with the mixing plows 32, with the chopper blades 52 rotated at high speeds. In that way, the chopper blades 52 may provide additional mixing and shearing of the material which is being mixed in the mixer 10. For example, the chopper assemblies 50 and the high speed chopper blades 52 introduce high impact and shear into the material and thus introduce heat therein for drying purposes. The chopper blades are also useful for dispersing fluids throughout a mix solution for the purposes of granulation. Furthermore, size reduction of mixed particles and deagglomeration of the mixed materials are also performed by chopper assemblies 50. In that way, mixer 10 of the invention provides a dual mixing process wherein the mixing plows 32 constantly bring material from the periphery of chamber 12 directly to the high-speed chopper assemblies.

Turning to FIG. 1A, a chopper assembly 50 is shown suitable for use with mixer 10. Assembly 50 utilizes a plurality of chopper blades 52 appropriately mounted on the chopper shaft 53 coupled to motor 51. Motor 51 is operable for rotating the shaft 53 and blades 52 in the range of approximately 3000–3600 RPM, for example, although different speeds and ranges could also be utilized. Higher or lower speeds may be utilized depending upon the mixing process. In one embodiment of the invention, as illustrated in the Figures, a plurality of individual chopper blades 52 are positioned on shaft 53 and are spaced along its length. Adjacent blades, such as blades 52*a*, 52*b* may also be oriented at 90° with respect to each other, as illustrated in FIG. 1A, such that two adjacent elongated blades form a cross formation to provide a cutting edge every 90m around the shaft 53. As illustrated in the figures, generally every other blade is oriented in the same direction, such that several layers of blade pairs are positioned along shaft 53. Appropriate washers or spacers 55 separate the blade pairs. The blades 52 couple with the shaft 53 proximate their centers. Another standoff spacer 56 maintains the blades 52 away from the inside surface 24 of the chamber. A threaded nut 57 secures the blades 52 and spacers 55 to shaft 53. The chopper blades shown in the figure s herein are one example of a chopper blade which might be utilized in accordance with the principles of the present invention. Other, various shaped blades may also be utilized with the present invention, and therefore, the invention is not limited to a particular blade shape.

Figure 3:
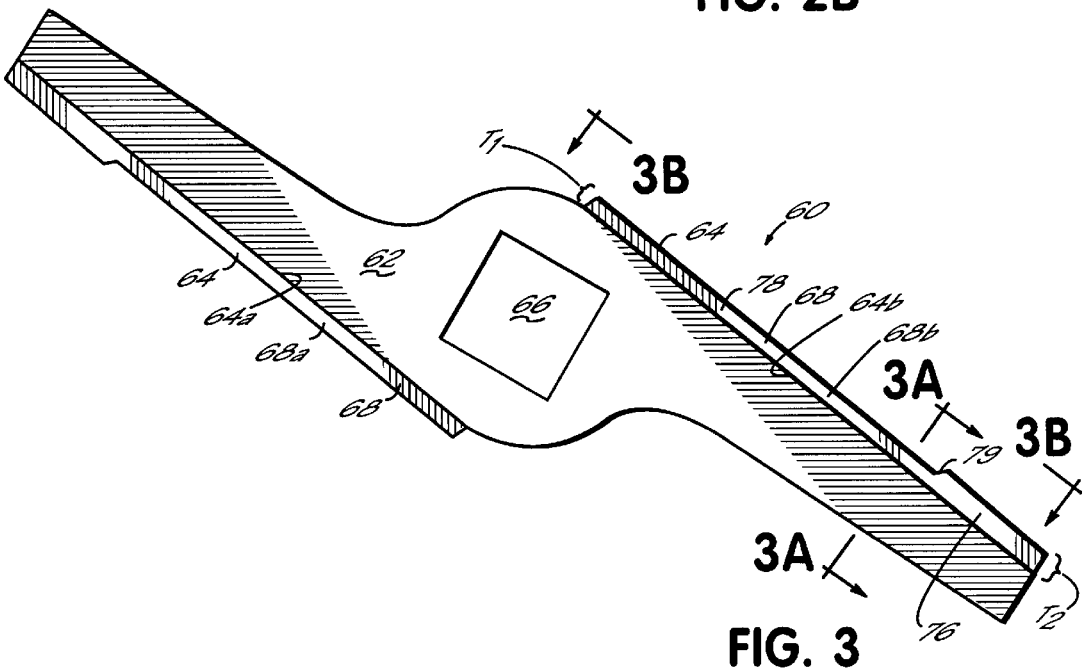
FIG. 3 is a side view of a chopper blade for use in a mixer in accordance with the principles of the present invention.

FIG. 3 illustrates one embodiment of a blade utilized in the chopper assembly 50 in mixer 10 in accordance with the principles of the present invention. Blade 60 comprises an elongated blade body 62 formed of an appropriate material, such as stainless steel. The blade body 62 includes at least one cutting edge 64 which will shear mixing material when the blade body 62 is rotated. In FIG. 3, the elongated blade 60 includes two opposing cutting edges 64*a*, 64*b* which are disposed 180° from each other along the longitudinal axis of the blade body 62 and which face in opposite directions. An aperture 66 is formed in the blade body 62 for receiving shaft 53 to mount the blade. Aperture 66 is shown to have a square cross-section to match a square cross-section (not shown) on the shaft. The square mounting aperture 66 is desirable for preventing rotation of the blade 60 on the shaft 53, rather than with the shaft. Other suitable aperture shapes and shaft shapes might be utilized for coupling blade 60 to the shaft 53.

Figure 3A:
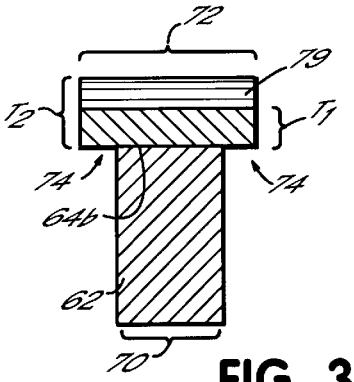
FIG. 3A is a cross-sectional view of the chopper blade of FIG. 3 along lines 3A—3A.

Blade 60 includes a tungsten carbide edge plate 68 which is mounted to each cutting edge 64*a*, 64*b*. The respective tungsten carbide edge plates for blade 60 are designated as 68*a* and 68*b*. The tungsten carbide edge plates 68*a*, 68*b* overlie the respective cutting edges 64*a*, 64*b* of blade 60, and thereby form the overall cutting edges of blade 60. Referring to FIG. 3A, the blade body 62 defines the cutting edge 64*b* which has a first width 70. The tungsten carbide edge plate is dimensioned to have a second width 72, which is wider than the first width 70 of the blade cutting edge to thereby completely overlie the cutting edge 64*b*. Plate 68*b* is preferably centered over edge 64*b* as shown in FIG. 3A. The tungsten carbide edge plate 68*b* prevents premature wear of the cutting edge 64*b* by taking the impact of the blade as it is rotated. The wider second width 72 of edge plate 68*b* prevents the mixed material that is being chopped from undercutting the edge plate 68*b* into the blade body 62, and specifically into cutting edge 64*b*, as illustrated by reference arrow 74. In that way, the integrity of the blade body 62 is protected during rotation. As will be appreciated, the significantly high speeds of rotation, for example in the range of 3000–3600 RPM, presents a significant wearing force at the cutting edges 64*a*, 64*b* of blade 60. The tungsten carbide edge plates 68 protect the cutting edges 64 and thus prevent significant wearing of that edge and ultimately prevent significant wearing of the blade 60 and blade body 62. The edge plates 68 act as the effective cutting edges of the blade and are much more durable than the stainless steel blade body 62. As a result, the blade body maintains its desired shape and dimensions for a significantly longer time, and does not have to be replaced as often as prior art blades. The mixer of the present invention thereby provides a significant improvement to prior art mixers and effectually increases the operational life span for the mixer between regular maintenance periods. The present invention further improves mixers by reducing the cost of maintaining and operating the mixers and increasing the overall efficiency of the mixing process. Specifically, the chopper blades 52 of the assemblies 50 do not have to be replaced as often and thus the invention reduces the operational and maintenance costs associated with blade replacement. The blades remain at a length close to their original length and are not significantly shortened. Shortened blades would lengthen the process time. Furthermore, the mixing process is more efficient because the time between required blade maintenance shutdowns is increased.

Figure 3B:
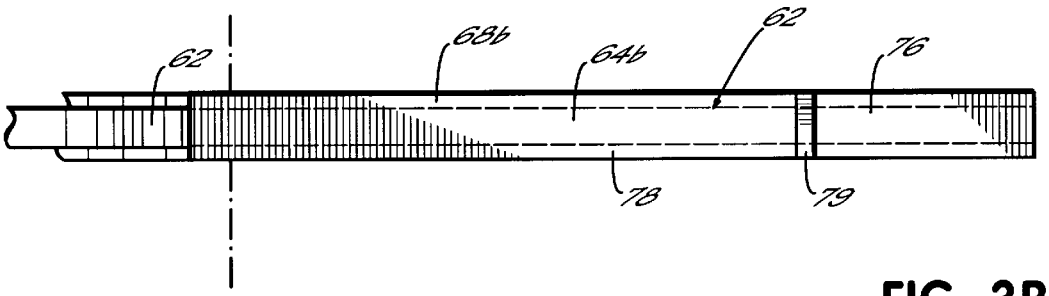
FIG. 3B is a cross-sectional view of the chopper blade of FIG. 3 along lines 3A—3A.

In accordance with another aspect of the present invention, the tungsten carbide edge plate 68 has a tip section 76 of increased thickness to handle the chopping forces at the tip of blade 62. The chopping forces withstood by the cutting edge 64 and the edge plate 68 are greater proximate the tip section 76 due to the radial distance of tip section 76 from the center of the blade body 62 proximate aperture 66, because the tip section is traveling at the greatest speed with respect to the rest of the blade. Referring to FIGS. 3, 3A, and 3B, the edge plate includes a body section 78 having a first thickness T1 and a tip section 76 having a second thickness T2. Thickness T2 is greater than thickness T1 such that the tip section 76 will be able to withstand considerable chopping forces without undue wear. In the embodiment illustrated in the figures, the body section 78 of the blade gradually transitions up to the tip section 76 at a smooth transition section 79.

Preferably, the edge plate 68 extends substantially along the length of each chopper blade cutting edge 64 to provide complete protection to the cutting edge 64. In one embodiment of the invention, the chopper blades have an overall length approximately in the range of 4"–8", although longer and shorter chopper blades might be utilized. As illustrated in FIG. 1A, the length of the blades might be reduced or tapered in length when moving along shaft 53 from nut 57 to surface 24. For example, as illustrated in FIG. 1A, the blades are longer proximate the shaft end at threaded nut 57 and get shorter progressing down the length of shaft 53 toward surface 24 and motor 51. Referring to FIG. 1, the length of the blades on shaft 53 may be tapered along the shaft as shown to provide for clearance of the mixing plows. As illustrated in FIG. 1, the plow 32 sweeps adjacent to the chopper assembly 50. Therefore, the blades closer to the surface 24 of the chamber 12 will be shorter to provide for clearance of the plows 32.

The tungsten carbide edge plate 68 is formed of a suitable tungsten carbide material such as material available from Good Earth Tools from Crystal City, Mo. 63019. The plate 68 is suitably mounted to the blade 62 such as by a welding technique or a soldering technique, such as a brazing technique. The edge plate should be suitably mounted to the blade to withstand significant shearing forces as the blade rotates and chops the material being mixed.

Figure 2A:
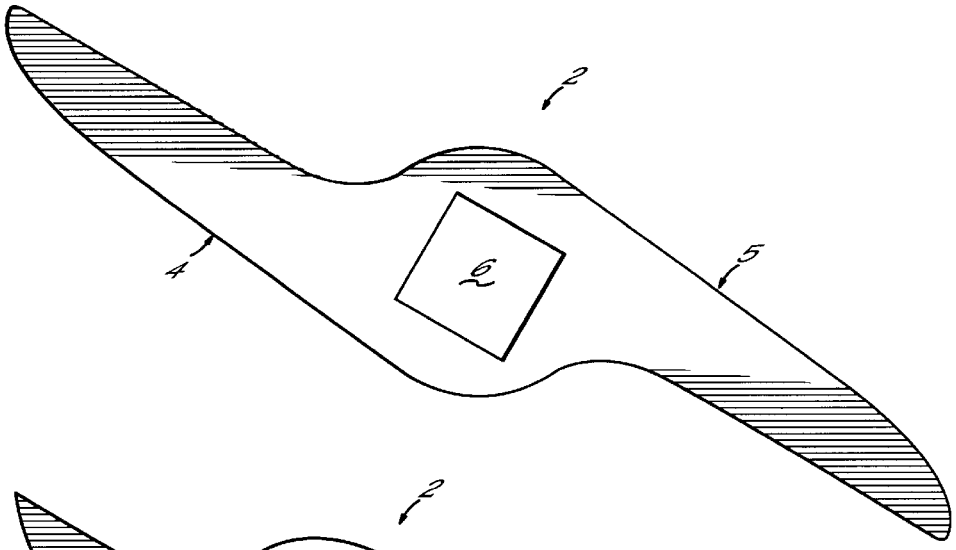
PRIOR ART FIG. 2A
FIG. 2A is a top view of a conventional chopper blade before usage.
Figure 2B:
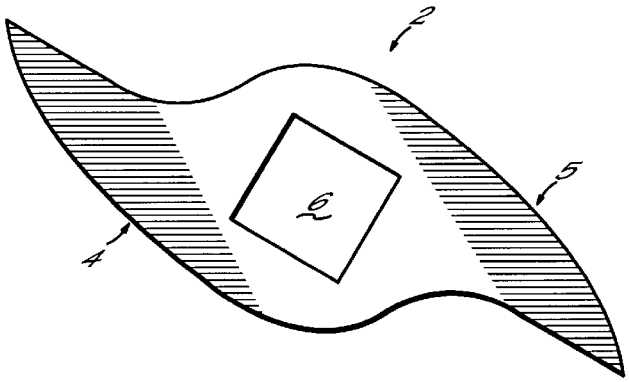
PRIOR ART FIG. 2B
FIG. 2B is a top view of the blade of FIG. 2A after use within a mixer.

To illustrate the significant improvement of the present invention, the chopper blade 2 show n in FIG. 2B exhibits the significant wear on the blade associated with its use in a mixing process. The blade 60, as utilized in the mixer 10 of the present invention, and as shown in FIG. 3, was utilized for a similar a mount of time under similar mixing conditions as blade 2 in FIG. 2B. The blade 60 maintained generally the same shape as illustrated in FIG. 3. Thereby, mixer 10 utilizing the chopper blade 60 in accordance is with the principles of the present invention, will require significantly less maintenance and blade replacement and thus will be more efficiently and more inexpensively utilized in the mixing process. Mixer 10 is there by cheaper to operate and maintain because of the significantly longer life of the chopper blades 60 and the blade assemblies 50. As may be appreciated, each of the blade assemblies may use 8 or more individual chopper blades 60. Therefore, replacement of those worn blades results in significant maintenance costs.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A mixer for mixing and processing materials comprising:

a mixing chamber having a mixing space therein configured for receiving material to be mixed;

an elongated rotatable mixing shaft extending through the mixing space;

a drive apparatus operably coupled to an end of the mixing shaft for rotating the shaft;

at least one mixing element coupled to the elongated shaft for being rotated within the mixing space to mix material within the space;

a chopper assembly comprising:

a chopper shaft extending into the mixing space and operable for being rotated;

at least one chopper blade coupled to the shaft to be rotated thereby for chopping material being mixed in the mixing space;

the chopper blade comprising an elongated blade body with at least one cutting edge having a first width;

an edge plate formed of a wear resistant material and mounted to the cutting edge of the chopper blade at an interface to overlie the cutting edge, the edge plate having a second width at said interface which is wider than the first width of the cutting edge at the interface to prevent undercutting and premature wear of the cutting edge during chopping;

the edge plate further comprising a body section and a tip section positioned at a radially outward end of the body section, the body section having a first thickness and the tip section having a second thickness greater than the first thickness for reinforcing the tip section of the edge plate;

whereby maintenance of the mixer is reduced while increasing the overall efficiency of the mixing process.

2. A mixer as in claim 1 wherein said wear resistant material includes tungsten carbide.

3. A mixer as in claim 1 wherein said mixing element comprises a mixing plow.

4. A mixer as in claim 1 wherein said edge plate extends substantially along the length of the chopper blade cutting edge.

5. A mixer as in claim 1 wherein said elongated chopper blade has a length approximately in the range of 4–8 inches.

6. A mixer as in claim 1 wherein said edge plate is brazed to the cutting edge of the chopper blade at said interface.

7. A mixer as in claim 1 wherein the chopper blade comprises a plurality of cutting edges, an edge plate overlying each of the cutting edges.

8. A mixer as in claim 1 further comprising a plurality of chopper blades coupled to the chopper shaft, the chopper blades being longitudinally spaced from each other along the length of the chopper shaft.

9. A mixer as in claim 1 wherein the body section gradually progresses from the first thickness up to the greater second thickness of the tip section.

* * * * *